United States Patent [19]

Nakai et al.

[11] 4,294,192

[45] Oct. 13, 1981

[54] LIQUID ELECTROSTATIC IMAGE DEVELOPING SYSTEM EMPLOYS MESH DEVELOPMENT ELECTRODE

[75] Inventors: Syunzi Nakai, Moriguchi; Motokazu Nakao, Sakurai, both of Japan

[73] Assignee: Sharp Kabushiki Kaisha, Osaka, Japan

[21] Appl. No.: 154,016

[22] Filed: May 28, 1980

[30] Foreign Application Priority Data

May 30, 1979 [JP] Japan ..... 54-67632

[51] Int. Cl.[3] ..... G03G 15/10

[52] U.S. Cl. ..... 118/650; 118/660; 118/661; 430/103; 430/119

[58] Field of Search ..... 118/650, 660, 661; 430/103, 119

[56] References Cited

U.S. PATENT DOCUMENTS 3,916,827 4/1975 Grant et al. ..... 118/650

*Primary Examiner*—John D. Welsh

*Attorney, Agent, or Firm*—Birch, Stewart, Kolasch and Birch

[57] ABSTRACT

A liquid developing system for developing an electrostatic latent image formed on a copy paper includes a mesh plate development electrode disposed in a traveling path of the copy paper so that the image carrying surface of the copy paper confronts the mesh plate development electrode. A developer liquid supplying roller is provided for supplying the developer liquid to the mesh plate development electrode for forming a swelling developer liquid surface on the mesh plate development electrode. The image carrying surface of the copy paper makes contact with the thus formed swelling developer liquid surface, and the superfluous developer liquid is removed through the mesh plate development electrode.

7 Claims, 6 Drawing Figures

LIQUID ELECTROSTATIC IMAGE DEVELOPING SYSTEM EMPLOYS MESH DEVELOPMENT ELECTRODE

BACKGROUND AND SUMMARY OF THE INVENTION

The present invention relates to a liquid developing system for developing an electrostatic latent image formed on a copy paper.

A liquid developing system has been developed in the field of electrostatic recording apparatuses. To achieve the clean developing, the following two points must be taken into consideration.

(1) The liquid developing system usually has a large time constant and a low developing density as compared with a dry toner developing system. Accordingly, an improvement is required in the liquid developing system for reducing the time constant and enhancing the developing density.

(2) A copy paper has a front surface coated with a high-molecular dielectric layer, but the rear surface of the copy paper is not coated with such a material. Therefore, there is a possibility that a developing liquid will penetrate into the copy paper when the developing liquid makes contact with the rear surface of the copy paper. This will deteriorate the quality of the obtained image. Accordingly, an improvement is required to preclude the developing liquid from reaching the rear surface of the copy paper.

Accordingly, an object of the present invention is to provide a liquid developing system for enhancing a developing density.

Another object of the present invention is to provide a liquid developing system for ensuring a clean development in an electrostatic recording apparatus.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a mesh plate development electrode is disposed above a liquid developer reservoir. A liquid developer supplying roller is disposed in the liquid developer reservoir so that a portion of the liquid developer supplying roller is immersed in the liquid developer and the liquid developer supplying roller contacts the mesh plate development electrode at the opposite portion thereof, thereby supplying the liquid developer to the mesh plate development electrode. A copy paper is driven to travel on the mesh plate development electrode in such a manner that the front surface of the copy paper makes contact with the mesh plate development electrode.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Referring now in detail to the drawings and to facilitate a more complete understanding of the present invention, conventional liquid developing systems will be first described with reference to FIGS. 1 through 3.

Figure 1:
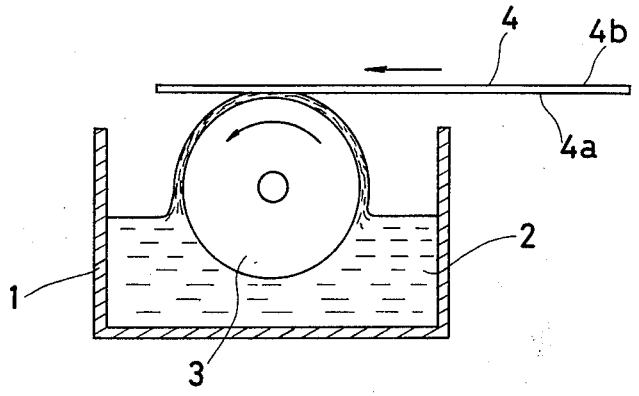
FIG. 1 PRIOR ART
FIG. 1 is a schematic sectional view of a liquid developing system of the prior art.

An example of the conventional liquid developing system of FIG. 1 mainly comprises a developer liquid reservoir 1, a developer liquid 2, and a developing roller 3, a portion of which is immersed in the developer liquid 2. The developing roller 3 is driven to rotate in a direction shown by an arrow in FIG. 1, whereby the developer liquid 2 is supplied upward around the developing roller 3. A copy paper 4 is driven to travel in a direction shown by an arrow in FIG. 1 in such a manner that a front surface **4*a*, on which an electrostatic latent image is formed, makes contact with the developer liquid 2 retained around the developing roller 3**.

By properly controlling the rotation timing of the developing roller 3, the developer liquid 2 which reaches the rear surface **4*b* of the copy paper 4 can be minimized, and the developing density can be substantially uniform. However, the developing density is not high because the copy paper 4 is driven to travel at a speed of several tens mm/sec. through several hundreds mm/sec. and a period of time during which the copy paper 4 contacts the developer liquid 2** is considerably short.

Figure 2:
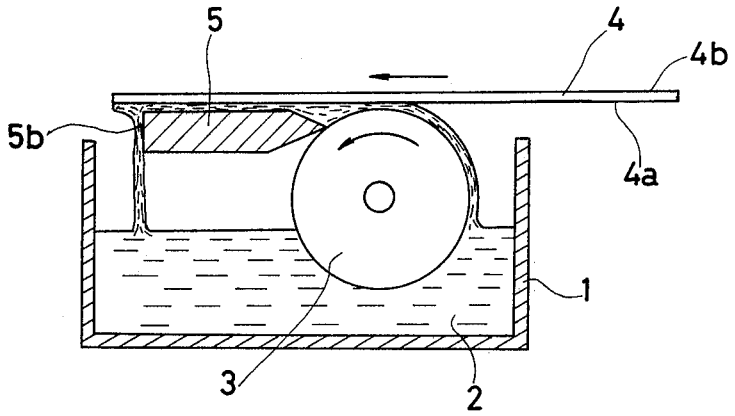
FIG. 2 PRIOR ART
FIG. 2 is a schematic sectional view of another liquid developing system of the prior art.
Figure 3:
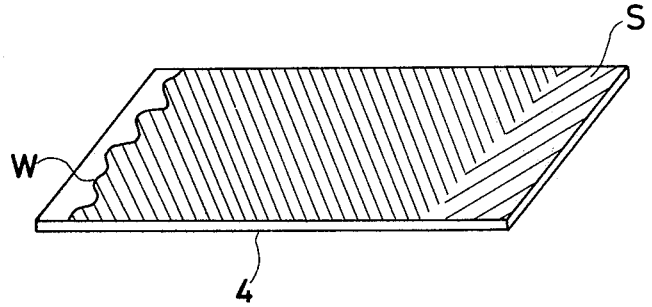
FIG. 3 PRIOR ART
FIG. 3 is a perspective view of a copy paper for explaining an operation mode of the liquid developing system of FIG. 2.

FIG. 2 shows another example of a conventional liquid developing system for enhancing the developing density. Like elements corresponding to those of FIG. 1 are indicated by like numerals.

A development electrode plate 5 is disposed adjacent to the developing roller 3 so that the developer liquid 2 supplied by the developing roller 3 is supplied to the upper surface of the developing electrode plate 5. The front surface **4*a* of the copy paper 4 makes contact with the developer liquid 2 retained on the developing roller 3 and on the developing electrode plate 5, whereby the time period during which the front surface 4*a* of the copy paper 4 contacts the developer liquid 2 is lengthened. The developing density can be properly controlled by selecting a desired length of the developing electrode plate 5**.

The present inventors have discovered disadvantages of the conventional liquid developing system of FIG. 2 through the following experiments.

The copy paper 4 is driven to travel at a speed 80 mm/sec. and the developing roller 3 is driven to rotate at a peripheral speed 1000 mm/sec. The developing roller 3 is driven to initiate the rotation at a timing wherein the leading edge of the supplied developer liquid 2 never precedes the leading edge of the copy paper 4 at the end **5*b*** of the developing electrode plate 5, and to terminate the rotation at a timing wherein the trailing edge of the copy paper 4 reaches several tens milimeter before the top of the developing roller 3.

In the above constructed development system, when the copy paper 4 is successively supplied to the liquid developing system with an interval of a short period, for example, 10 sec. to 60 sec., there is a possibility that the rear surface 4*b* of the copy paper 4 will taint due to the developer liquid 2 at the leading and trailing edges. The above-mentioned taint is considered to be caused by the developer liquid 2 held on the developing electrode plate 5 even when the developing roller 3 is not driven to rotate. The thus held developer liquid 2 may be caught by the leading edge or the trailing edge of the copy paper 4.

In the above constructed development system, when the copy paper 4 is supplied to the liquid developing system with an interval of a considerably long period, for example, more than ten minutes, the above discussed taint can be minimized because the developer liquid 2 disappears from the upper surface of the developing electrode plate 5 while the developing roller 3 is held stationary. However, there is a possibility that a nonuniform developing will occur at the leading edge of the copy paper 4 due to the nonuniform alignment of the leading edge of the developer liquid flow, as shown by a portion W in FIG. 3. Moreover, the trailing edge portion S in FIG. 3 has a lower developing density than the remaining portion because the developer liquid 2 is not forced to flow when the trailing edge of the copy paper 4 is driven to travel above the developing electrode plate 5.

Figure 4:
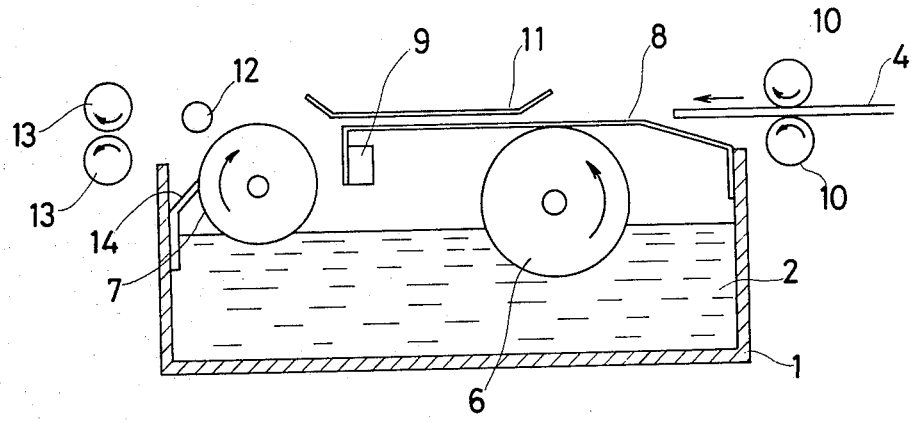
FIG. 4 is a sectional view of an embodiment of the liquid developing system of the present invention.

FIG. 4 shows an embodiment of a liquid developing system of the present invention. Like elements corresponding to those of FIGS. 1 and 2 are indicated by like numerals.

The liquid developing system of the present invention mainly comprises a cylinder shaped developer liquid supplying roller 6 and a cylinder shaped drying roller 7. The rollers 6 and 7 are rotatably supported by side walls of the developer liquid reservoir 1, and driven to rotate in directions shown by arrows in FIG. 4. The developer liquid supplying roller 6 has a longitudinal length slightly shorter than the width of the copy paper 4, and the drying roller 7 has a longitudinal length slightly longer than the width of the copy paper 4. The developer liquid 2 is disposed in the developer liquid reservoir 1 so that a portion of the developer liquid supplying roller 6 is immersed in the developer liquid 2.

A mesh plate development electrode 8 is disposed above the developer liquid supplying roller 6 in such a manner that the mesh plate development electrode 8 contacts or is positioned near the top of the developer liquid supplying roller 6. The mesh plate development electrode 8 has a width slightly wider than the width of the copy paper 4, and has a length sufficient for obtaining a desired developing density, for example 50 mm. The mesh plate development electrode 8 comprises a stainless steel mesh plate having 30 meshes per one inch length, each stainless steel having a diameter about 0.2 through 0.3 mm.

The mesh plate development electrode 8 is disposed above the developer reservoir 1 in a fashion that one end thereof is fixed to one wall of the developer liquid reservoir 1 and the other end is supported by a bar 9, which is extended across the developer liquid reservoir 1 and supported by the side walls of the developer liquid reservoir 1.

The liquid developing system of FIG. 4 further includes paper feed rollers 10 and 13, a guide plate 11 for guiding the copy paper 4 above the mesh plate developing electrode 8, and a guide bar 12 for ensuring the tight contact of the copy paper 4 against the drying roller 7. A blade 14 is disposed to contact the drying roller 7, thereby removing the developer liquid 2 from the drying roller 7.

An electrostatic latent image is formed on the front surface 4*a* of the copy paper 4 while the copy paper 4 travels through a latent image forming section. After passing the latent image forming section, the copy paper 4 is cut to a desired length. Of course, an already cut copy paper 4 can be introduced into the latent image forming section. The thus supplied copy paper 4, carrying the electrostatic latent image formed on the front surface 4*a* thereof, is transferred through the liquid developing system by the paper feed rollers 10.

Figure 5:
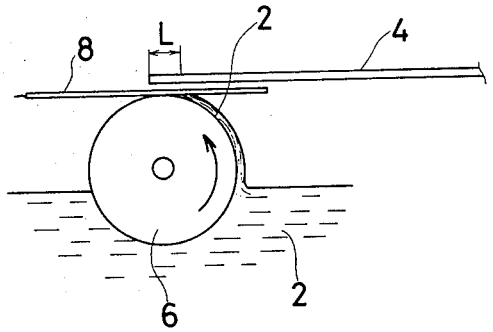
FIGS. 5 and 6 are sectional views of an essential part of the liquid developing system of FIG. 4 for explaining the operation mode of the liquid developing system of FIG. 4.

When the leading edge of the copy paper 4 reaches the top of the developer liquid supplying roller 6, the developer liquid supplying roller 6 is driven to initiate the rotation, whereby the developer liquid 2 is supplied toward the mesh plate development electrode 8. The peripheral speed of the developer liquid supplying roller 6 is selected higher than ten times the transfer speed of the copy paper 4 and, therefore, the developer liquid 2 is suddenly supplied to the mesh plate development electrode 8. FIG. 5 shows a condition immediately after the rotation of the developer liquid supplying roller 6 is initiated. The thus supplied developer liquid 2 is introduced into the upper surface of the mesh plate development electrode 8 through the mesh plate development electrode 8, and forms swelling liquid surface of a width L on the top of the developer liquid supplying roller 6. The height of the swelling liquid surface is controlled by adjusting the rotation velocity of the developer liquid supplying roller 6 and the mesh density of the mesh plate development electrode 8. The thus formed swelling liquid surface contacts the front surface 4*a* of the copy paper 4 to develop the latent image carried on the copy paper 4.

Figure 6:
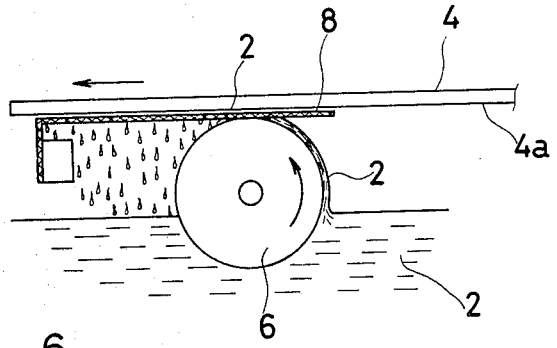

Since the swelling liquid surface is accurately formed with the width L, the developing density at the leading edge of the copy paper 4 is uniform. The swelling liquid surface is continuously formed while the copy paper 4 is driven to travel above the developer liquid supplying roller 6. The developer liquid attached to the front surface 4*a* of the copy paper 4 is removed from the copy paper 4 while the copy paper 4 travels above the mesh plate developing electrode 8 and returned to the developer liquid reservoir 1 through the mesh plate development electrode 8 as shown in FIG. 6. Accordingly, the front surface 4*a* of the copy paper 4 becomes close to the mesh plate development electrode 8, whereby the developing density is greatly enhanced.

When the copy paper 4 is further transferred and reaches the drying roller 7, the remaining developer liquid attached to the front surface 4*a* of the copy paper 4 is completely removed. Then, the copy paper 4 carrying the developed image formed thereon is further transferred by paper feed rollers 13. When the trailing edge of the copy paper 4 reaches a predetermined position near the top of the developer liquid supplying roller 6, the rotation of the developer liquid supplying roller 6 is terminated. The swelling liquid surface formed on the mesh plate development electrode 8 near the top of the developer liquid supplying roller 6 suddenly disappears because the developer liquid 2 is returned to the developer liquid reservoir 1 through the mesh plate development electrode 8. Therefore, the rear surface 4*b* of the trailing edge section will never be made contact with the developer liquid 2.

The initiation and termination of the rotation of the developer liquid supplying roller 6 are controlled through the use of sensors (not shown) for detecting the leading edge and the trailing edge of the traveling copy paper 4.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A liquid development system for developing an electrostatic latent image formed on a copy paper through the use of a developer liquid, said liquid development system comprising in combination:

a mesh shaped development electrode disposed in the traveling path of a copy paper above a developer liquid reservoir;

a liquid developer supplying means for supplying the developer liquid from said reservoir to said mesh shaped development electrode; and a copy paper feed means for transferring said copy paper above said mesh shaped development electrode in a manner that the front surface of said copy paper, on which said electrostatic latent image is formed, makes contact with or is positioned in close proximity to said mesh shaped development electrode.

2. The liquid developer system of claim 1, wherein said mesh shaped developer electrode comprises a mesh metal plate having a width wider than the width of said copy paper, and a length at least 50 mm.

3. The liquid developing system of claim 2, wherein said developer liquid supplying means comprises a cylinder shaped developer liquid supplying roller transversely disposed in said developer liquid reservoir, the bottom portion of said cylinder shaped developer liquid supplying roller being dipped into the developer liquid contained in said developer liquid reservoir, and the top portion of said cylinder shaped developer liquid supplying roller being positioned close to said mesh shaped developing electrode.

4. The liquid developer system of claim 3, further comprising:

a drying roller disposed at the downstream of the traveling path of said copy paper for removing the excess developer liquid from the underside of said copy paper.

5. The liquid developer system of claim 1 or 2 wherein said liquid developer supplying means comprises a cylinder shaped developer liquid supplying roller transversely disposed in said developer liquid reservoir, the bottom portion of said cylinder being immersed in the developer liquid contained in said developer liquid reservoir, with the top portion of said cylinder being positioned in close proximity to said mesh shaped development electrode.

6. The liquid developer system of claim 4, wherein said cylinder shaped developer liquid supply roller is rotatably mounted so as to rotate in the same direction as the traveling copy paper and said drying roller is rotatably mounted so as to rotate in a counter-direction to the traveling copy paper.

7. The liquid developer system of claim 5, wherein said cylinder shaped developer liquid supplying roller has a longitudinal length slightly shorter than the width of said mesh shaped development electrode.

* * * * *